US006427413B1

(12) United States Patent
Lafrance

(10) Patent No.: US 6,427,413 B1
(45) Date of Patent: Aug. 6, 2002

(54) GROOVED CONSTRUCTION LUMBER FOR CONSTRUCTING LUMBER STRUCTURES

(76) Inventor: Claudex Lafrance, 196, 48ième Rue Ouest, Charlesbourg (CA), G1H 5G1

( * ) Notice: Subject to any disclaimer, the term of this patent is extended or adjusted under 35 U.S.C. 154(b) by 0 days.

(21) Appl. No.: 09/629,211

(22) Filed: Jul. 31, 2000

(51) Int. Cl.[7] ..... E04C 3/00; E04C 3/30

(52) U.S. Cl. ..... 52/578; 52/481.1; 52/241; 52/238.1; 52/317; 52/733.2; 52/733.3; 52/105; 446/105; 446/106; 446/124

(58) Field of Search ..... 52/578, 481.1, 52/241, 238.1, 317, 733.2, 733.3, 105; 446/105, 106, 124

(56) References Cited

U.S. PATENT DOCUMENTS 4,270,304 A * 6/1981 Sofer ..... 52/243
4,372,076 A * 2/1983 Beck ..... 52/233
5,274,973 A * 1/1994 Liang ..... 52/243
5,477,651 A * 12/1995 Fitzgibbon ..... 52/302.1

* cited by examiner

*Primary Examiner*—Carl D. Friedman
*Assistant Examiner*—Chi Q. Nguyen
(74) *Attorney, Agent, or Firm*—Swabey Ogilvy Renault; Guy J. Houle

(57) ABSTRACT

A grooved construction lumber element for use in constructing lumber structures such as wall framing, roof trusses, load bearing beams, deck and stair railings, and the like, is described. The construction lumber element is comprised of a straight lumber piece having a plurality of spacing grooves disposed in at least one surface of the lumber piece. The spacing grooves have a predetermined depth and are configured to receive therein an associated further lumber element to construct a specific building structure. At least some of the spacing grooves are disposed at common spaced intervals. The lumber element is preferably an elongated straight wood lumber piece of rectangular cross-section and defines opposed flat parallel surfaces and opposed flat parallel side edge surfaces. The spacing grooves are formed in one of the flat surfaces.

9 Claims, 7 Drawing Sheets

GROOVED CONSTRUCTION LUMBER FOR CONSTRUCTING LUMBER STRUCTURES

FIELD OF THE INVENTION

A grooved construction lumber element is described for constructing lumber structures such as portions of a house frame, building walls, guard rails for decking or verandas and the like structures wherein lumber pieces are secured at repeat spaced intervals.

BACKGROUND OF THE INVENTION

In the construction of lumber structures, such as wood building structures, it is necessary to erect walls, flooring, roofing wherein load bearing elements such as joists, studs, trusses, are secured at substantially equidistantly spaced intervals. When constructing a wall with wood framing studs it is necessary to secure the studs to a top surface of a lower plate at spaced intervals. These spaced intervals are usually measured using a measuring tape and a pencil mark is made on the plate at the repeat intervals. These measurements are not always accurate and subject to human errors as the construction worker must remember ascending numbers of a predetermined spaced intervals and often makes a human error and a stud may be secured at the wrong position and this is detected later on when it is time to cover the framing with covering sheet material of predetermined size.

Another disadvantage in the construction of building structures wherein lumber elements must be spaced at regular intervals is that the butt end of the studs are usually secured on a side surface of a bottom or top plate member by nails. Because often construction lumber is not totally dry the studs will warp longitudinally as they slowly dry and this results in an irregular wall surface.

A still further disadvantage in the construction of building structures wherein lumber elements must be secured at regular spaced intervals is that such construction requires skill labor and it can be said to be time-consuming due to the fact that many measurements need to be taken not to make errors and when errors occur it is time-consuming to rectify them. It is also time-consuming to groove lumber pieces to interconnect butt ends of studs in a base plate. It is also time-consuming to construct guard railings where rail posts need to be secured at regular spaced intervals without error. For these reasons, it is costly to construct these types of structures.

SUMMARY OF THE INVENTION

It is a feature of the present invention to provide a grooved construction lumber element for use in constructing lumber structures and which substantially overcomes the above-mentioned disadvantages of the prior art.

Another feature of the present invention is to provide a grooved construction lumber element for use in the construction of building structures and which is comprised by a straight lumber piece provided with a plurality of spacing grooves disposed in at least one surface thereof whereby to permit lumber elements to be secured thereto at predetermined spaced intervals.

Another feature of the present invention is to provide a grooved construction lumber element for use in constructing building structures and comprised of a straight lumber piece having a plurality of spacing grooves disposed in at least one surface thereof and which permits the butt end of lumber element to be connected in the grooves and wherein the grooves substantially arrest the problem of distortion of the lumber element.

Another feature of the present invention is to provide a grooved construction element for use in constructing building structures and wherein such structures may be constructed by unskilled labor and permits near flawless erection of such building structures.

According to the above features, from a broad aspect, the present invention provides a grooved construction lumber element for use in constructing lumber structures. The construction lumber element is comprised of a straight lumber piece having a plurality of spacing grooves disposed in at least one surface of the lumber piece. The spacing grooves have a predetermined depth and are configured to receive therein an end portion of an associated further lumber element to construct a specific structure. At least some of the spacing grooves are disposed at common spaced intervals.

BRIEF DESCRIPTION OF THE DRAWINGS

The preferred embodiments of the present invention will now be described with reference to the accompanying drawings in which.

DESCRIPTION OF PREFERRED EMBODIMENTS

Figure 1:
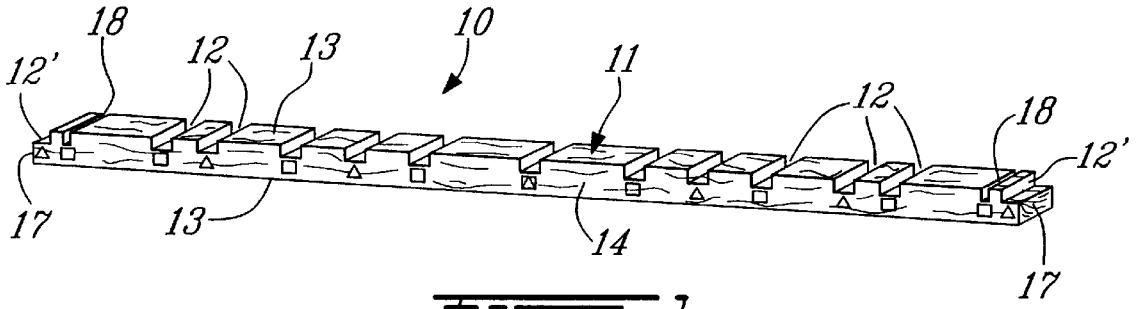
FIG. 1 is a perspective view of a grooved construction lumber element of the present invention for use in constructing building structures and particularly, but not exclusively, for erecting wood framed walls.
Figure 2:
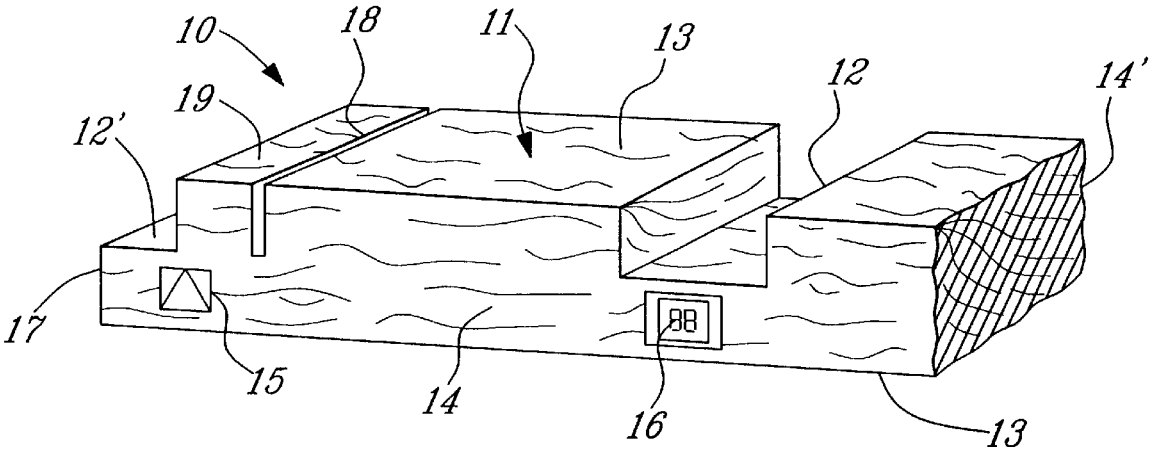
FIG. 2 is a perspective view of a fragmented end section of the grooved construction lumber element of FIG. 1.

Referring now to the drawings and more particularly to FIGS. 1 and 2 there is shown generally at 10 a grooved construction lumber element, constructed in accordance with the present invention and for use in the construction of wooden structures, such as building structures. The construction lumber element is comprised of a straight lumber piece 11 provided with a plurality of spacing grooves 12 disposed in a top side surface 13 of the lumber piece. The spacing grooves 13 are better illustrated in FIG. 2 and as can be seen have a predetermined depth and are configured, herein rectangular in shape, to receive therein an end portion of an associated further lumber element to construct a specific building structure, as will be described later.

As shown in FIG. 1 there are several spacing grooves formed in the top side surface 11 of the lumber piece 11 and there are one or more groups of these spacing grooves, each group having a different interval spacing of spacing grooves and disposed throughout the length of the lumber piece 11. In order to identify the grooves of specific groups there is provided an identification means on the side surface 14 of the lumber piece 11 and as herein shown it is provided by a shape symbol 15. As shown in FIG. 1 there are square and triangular symbols wherein all of the grooves associated with the square symbols have a predetermined interval spacing, herein 12 inch spacing and the grooves of the triangular symbol have a spacing of 18 inches. The identification means could also be a color symbol such as a colored dot or it could be a number, such as the number at 16 shown in FIG. 2.

The straight lumber piece 11 may be fabricated from various types of construction material such as wood, plastic, laminates or composites. The lumber pieces are of rectangular cross-section and defines opposed parallel top and bottom surfaces 13 and 13' and opposed parallel flat side edge surfaces 14 and 14'. It is also pointed out that by using symbol identification means 15 a color-blind person could easily identify associated spacing grooves.

It is also pointed out that the spacing grooves 12 have a common width. The end spacing grooves 12' extend to opposed end edges of the straight lumber piece and have a width which is half of the width of the other spacing grooves 12. A transverse saw blade slit 18 extends across the top side surface 13 and space from each of the opposed end edges 17 of the lumber piece 11 a distance equal to the width of the end grooves 12'. The transverse saw blade slit 18 has the same depth as the spacing grooves and permits extension of the end spacing groove 12' by removal of the intermediate lumber piece 19 disposed between the end spacing groove 12' and the slit 18 whereby the end spacing groove 12' may have the same width as the other spacing grooves to mount a vertical end stud, such as the stud 20 as shown in FIG. 3*a*.

Figure 3A:
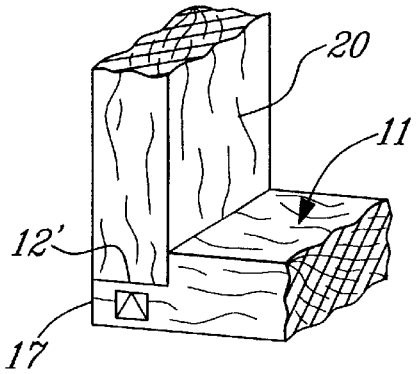
FIG. 3*a* is a fragmented perspective view showing a stud butt end secured in the end spacing groove.
Figure 3B:
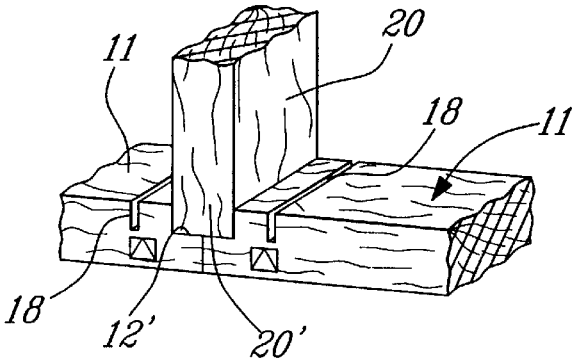
FIG. 3*b* is a fragmented perspective view showing a butt end of a stud secured in an end spacing groove of opposed ends of two construction lumber elements of FIG. 1.

As shown in FIGS. 3*a* and 3*b* the straight lumber pieces 11 are herein used as base plate runners utilized in the framing of walls. The spacing grooves 12 accommodate a connecting butt end of wall framing studs 20 which are secured in selected ones of the groups of spacing grooves.

As shown in FIG. 3*b* the butt end 20' of the stud 20 is secured between opposed end spacing grooves 12' of adjacent lumber pieces 11. When these two end spacing grooves 12' are disposed side by side they together form a spacing groove equal in width to the standard spacing grooves 12.

Figure 4:
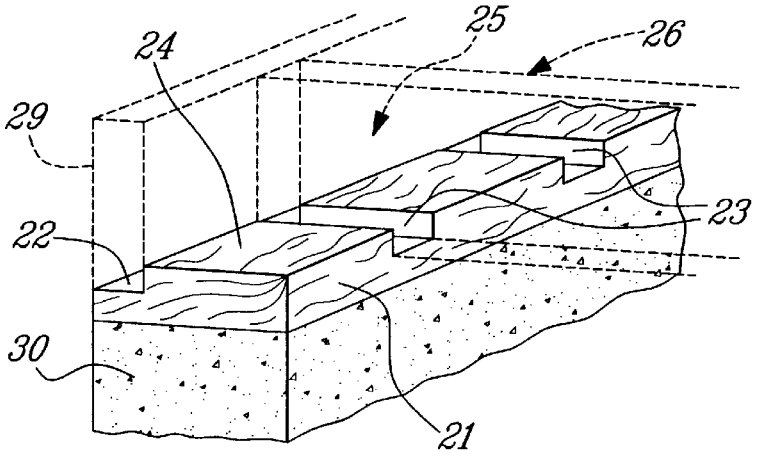
FIG. 4 is a fragmented perspective view showing a further grooved construction lumber element constructed in accordance with the present invention and herein represented as a joist support foundation runner.
Figure 5A:
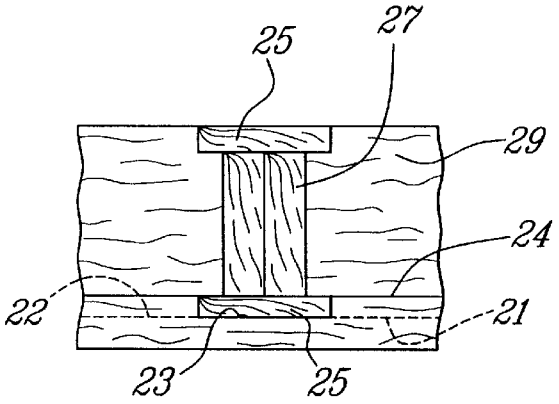
FIG. 5*a* is a fragmented side view showing an H-Beam secured in the spacing grooves of a foundation runner constructed in accordance with the present invention.
Figure 5B:
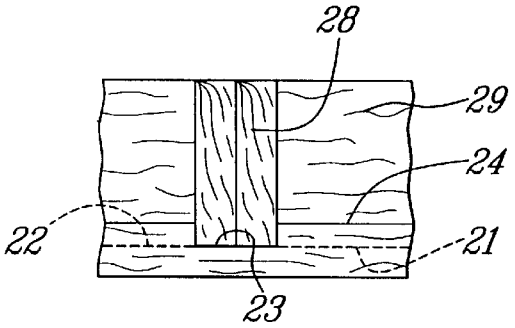
FIG 5*b* is a view similar to FIG. 5*a* but wherein the beam is formed by lumber boards secured together.

Referring now to FIGS. 4, 5*a* and 5*b* the straight lumber piece is herein constituted by a joist support foundation runner 21. The foundation runner 21 is provided with an outer edge groove 22 extending along the entire length of the foundation runner 21. The outer edge groove 22 has the same depth as the spacing grooves 23 formed in the top flat side surface 24 of the foundation runner 21 and are dimensioned, herein substantially of rectangular cross-section, to receive support end sections 25 of horizontally disposed joists beams 27 and 28 as shown in FIGS. 5*a* and 5*b* respectively. The outer edge groove 22 accommodates a lower longitudinal edge portion of an end cap board 29.

Such structure is for framing a floor over a foundation wall 30. As shown in FIG. 5*a* the beam 26 is an I-beam formed with construction wood pieces or laminated wood pieces. The beam 28 as shown in FIG. 5*b* is constructed of interconnected wood planks. The size of the spacing grooves 23 may also vary to accommodate different size of beams or joists.

Figure 6:
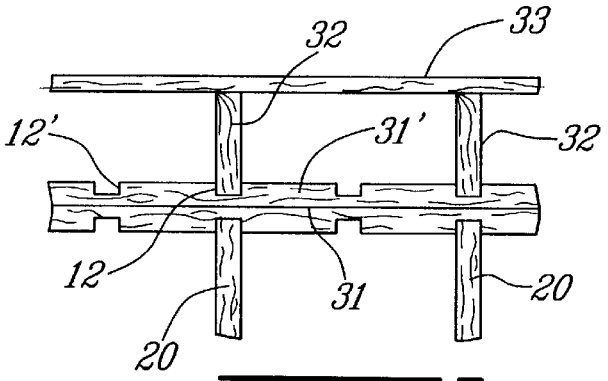
FIG. 6 is a fragmented side view showing two top runners secured to one another by two support joists of a top floor.

With reference now to FIG. 6 there is shown a top plate runner 31 secured to the top butt ends of studs 20 and wherein a further plate runner 31' is secured to the top plate runner but in an inverted manner whereby to receive in its spacing grooves 12, which are now disposed upwardly, end portions of floor joists 32. A floor surface material 33 is secured to the floor joist 32 to start the construction of a second floor of a building structure. The plate runner 31' may also support the horizontal cross-connecting piece of a roof trust. As herein shown some of the spacing grooves 12' are not utilized as they form part of another group of unselected spacing grooves.

Figure 7:
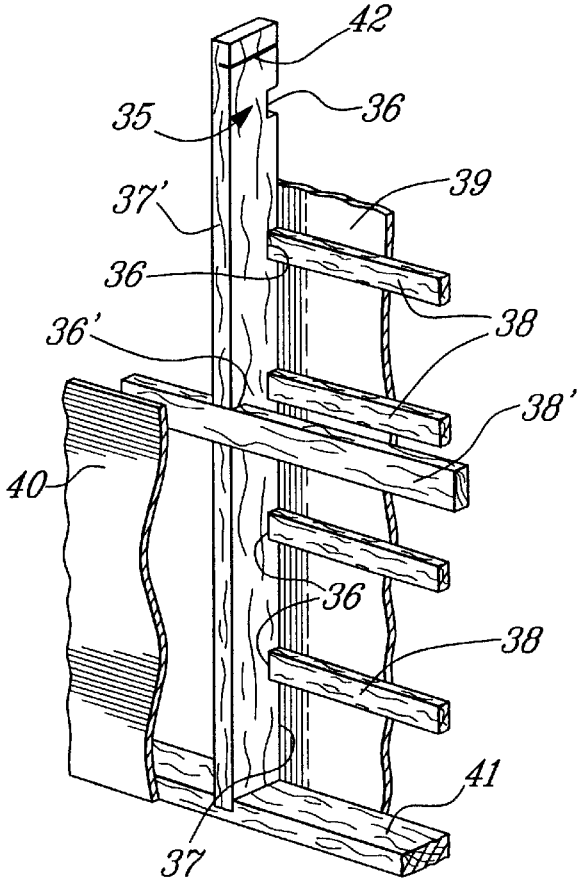
FIG. 7 is a fragmented perspective view wherein the construction lumber element of the present invention is represented by a stud having spacing grooves formed in one of the side edge surfaces thereof.

In FIG. 7 the straight lumber piece of the present invention is herein constituted by a stud 35. The spacing grooves 36 are disposed in one of the side edges 37 of the stud 35 to accommodate transverse furring strips 38 to secure an outer wall covering material 39 thereto. Spacing grooves, herein groove 36' is also disposed in the opposed side edge surface 37' and it is also used to connect a furring 38' to secure inner wall boards, such as wall board 40 at a space interval of 4 feet between the lower edge of the base plate runner 41 and the center of the furring 38'. It can be appreciated that by providing studs and runners constructed in accordance with the present invention that walls are always constructed with the lumber pieces always perfectly disposed whereby the constructed walls are always perfectly framed. A saw slit 42 may also be provided adjacent an end, herein in the top end of the stud 35 to provide an indication where the stud is to be cut depending on the desired height of the wall being constructed.

Figure 8A:
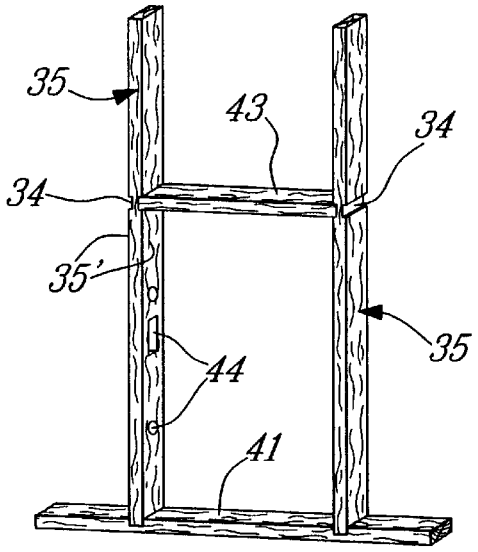
FIG. 8*a* also shows a stud but wherein the spacing grooves are formed in opposed flat side surfaces of the stud.
Figure 8B:
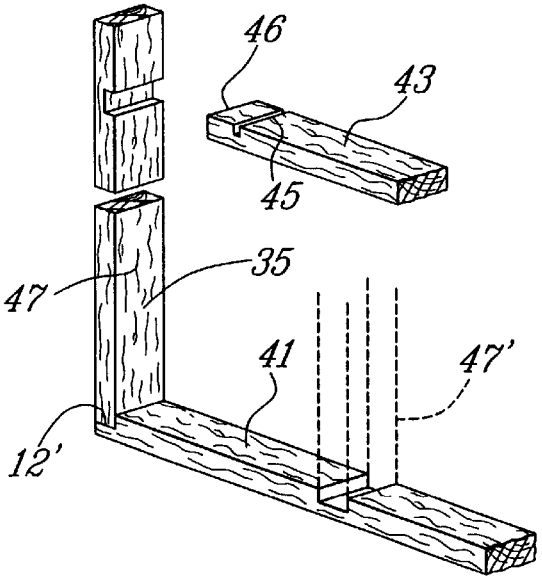
FIG. 8*b* is a fragmented perspective view showing a spacing brace mounting between an end stud secured in an expanded end spacing groove.

As shown in FIGS. 8*a* and 8*b* the stud 35 is provided with spacing grooves 34 in opposed flat side surfaces 35' thereof and there is at least one groove in each of the opposed flat side surfaces and aligned with one another to receive an end portion of a transverse brace piece 43. Holes 44 may also be formed in the side surfaces 35' to accommodate wiring or piping. Also, shown in FIG. 8*b* the brace element 43, which is herein a rectangular wood piece, may be provided with a saw blade slit 45 extending transversely a predetermined distance from an end 46 of the brace element to allow the removal of an end portion of the wood brace element to brace an end stud 47 to an adjacent stud 47', when the end stud 47 occupies the entire end groove 12'.

Figures 9, 10:
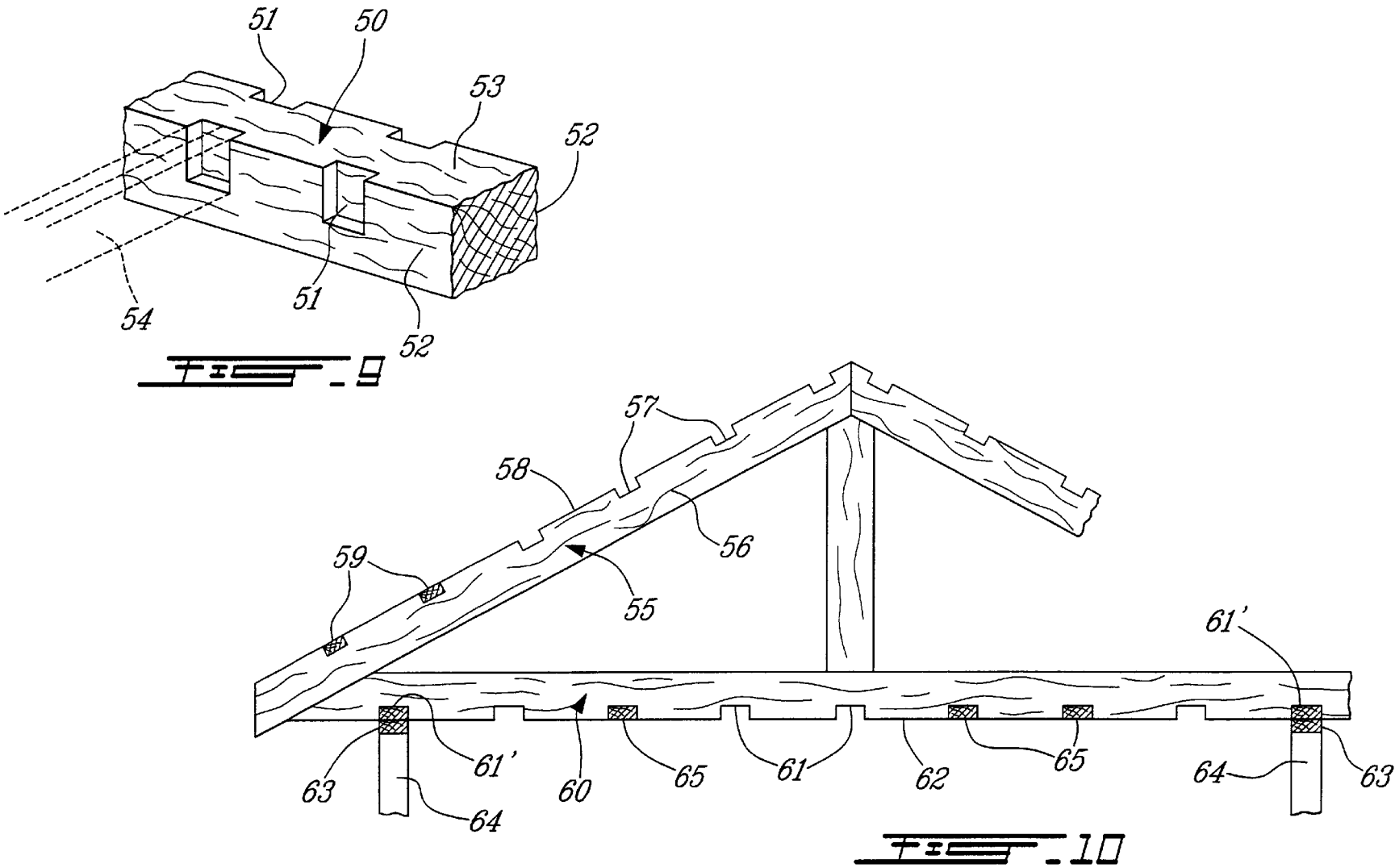
FIG. 9 is a perspective fragmented view and wherein the groove construction lumber element of the present invention constitutes a support beam.
FIG. 10 is a simplified side view showing the construction lumber element of the present invention used in the construction of roof trusses.

As shown in FIG. 9 the straight lumber piece of the present invention is herein constituted as a load bearing beam 50 with the spacing grooves 51 being disposed in opposed side surfaces 52 and extending to the top surface 53 of the beam. The spacing grooves 51 are herein shown as receiving an end portion of a joist 54 for the construction of a floor.

In FIG. 10 the straight lumber piece of the present invention is herein used in the construction of a roof trusses 55 with the truss pieces 56 having spacing grooves 57 on its top edge 58 to receive boards 59 to which construction sheeting material may be secured. The straight lumber piece may also be used in the truss design as the horizontal cross connecting piece 60 and wherein the spacing grooves 61 are disposed in a lower side edge 62 thereof. At least some of the spacing grooves, herein the end grooves 61' are adapted to receive the top plate runners 63 of the framed wall 64. The intermediate spacing grooves 61 will receive furring pieces such as piece to attach ceiling boards (not shown) thereto.

Figure 11:
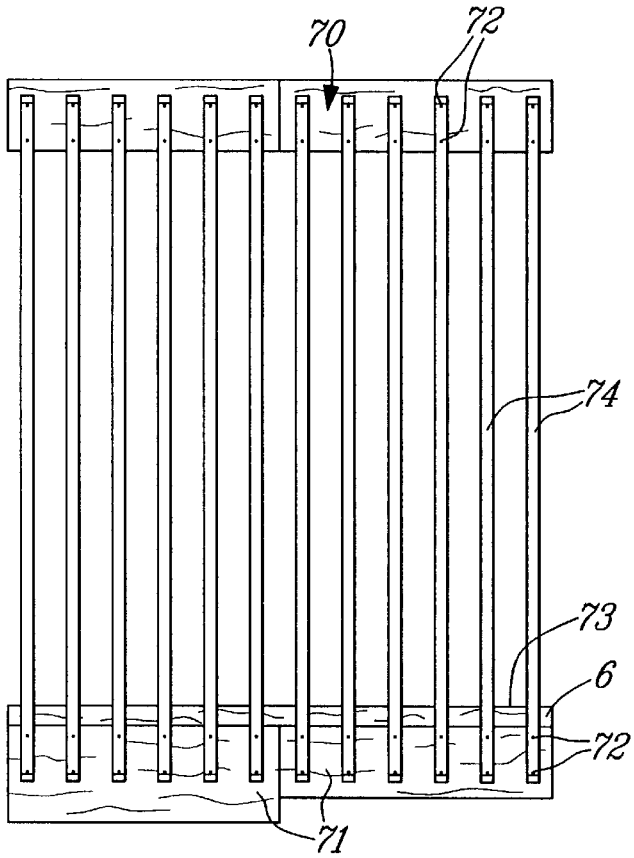
FIG. 11 is a side view of a prefabricated deck rail constructed in accordance with the present invention.
Figure 12A:
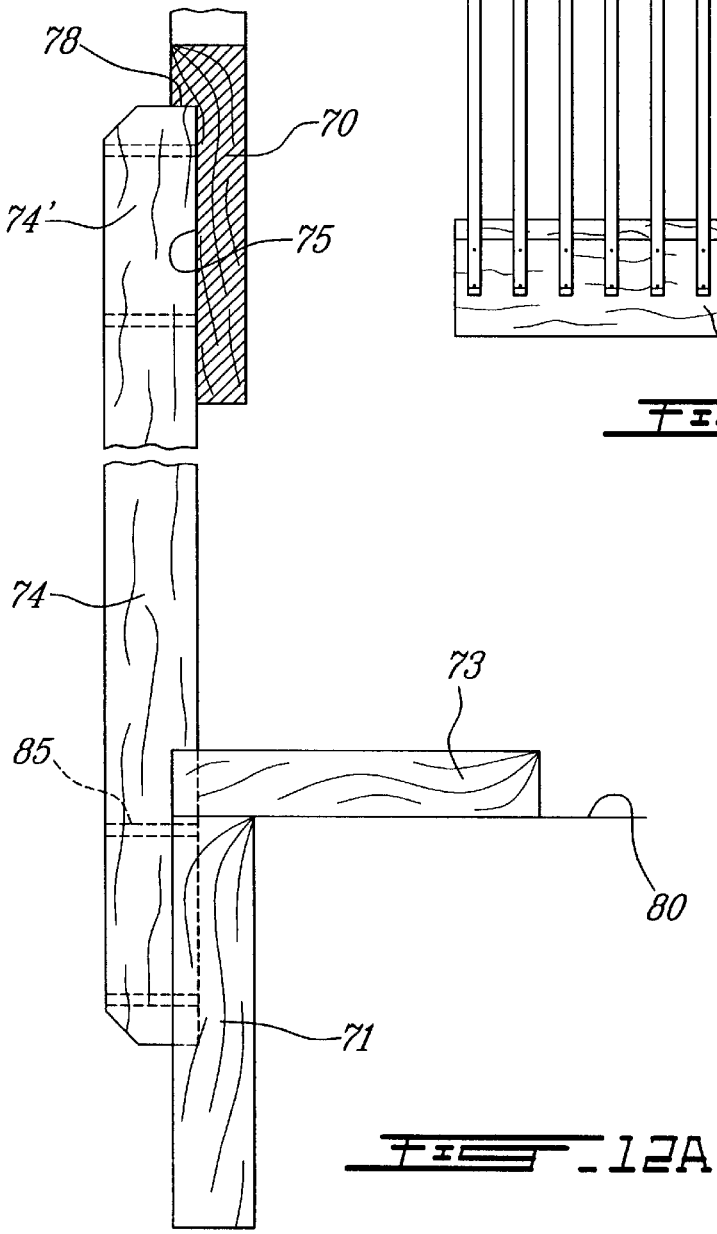
FIG. 12*a* is a section side view showing the deck rail construction.
Figure 12B:
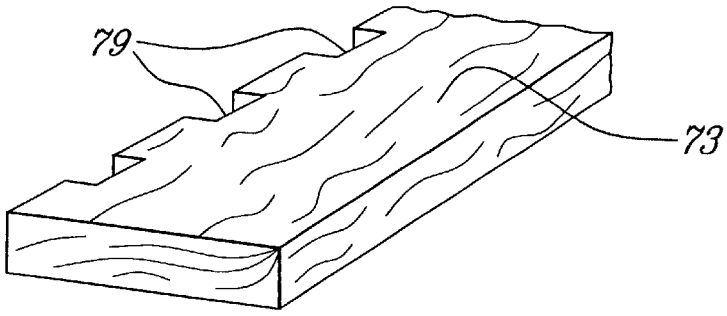
FIG. 12*b* is a perspective view showing the construction of the edge floorboard.
Figure 12C:
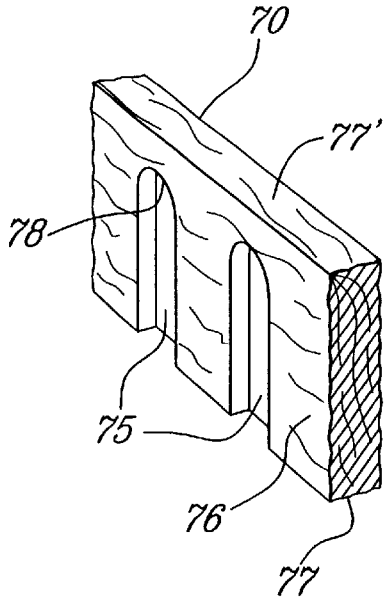
FIG. 12*c* is a fragmented perspective view showing the construction of the horizontal top rail.
Figure 12D:
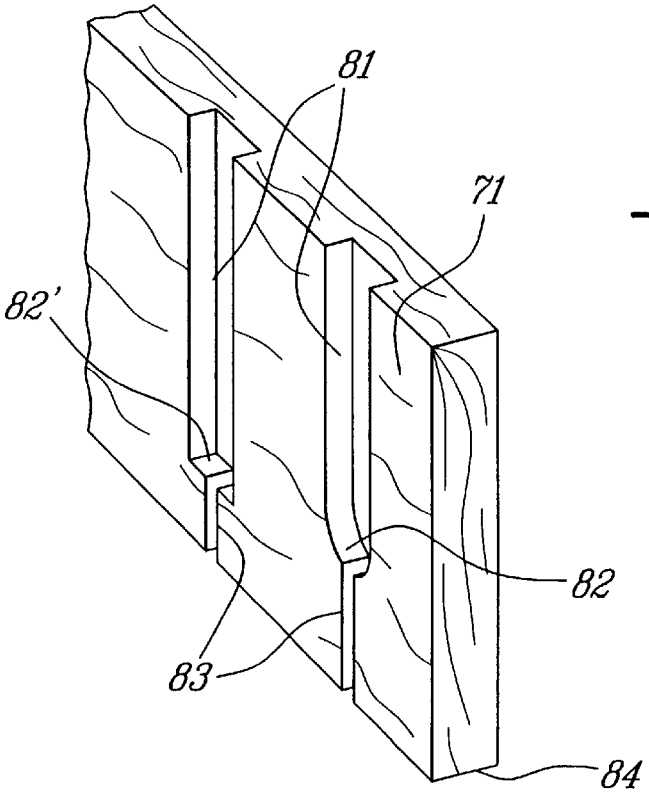
FIG. 12*d* a fragmented perspective view showing the construction of the bottom attachment plate.

Referring now to FIGS. 11 through 12*d* there will be described the construction of a railed fence for decks, porches and staircases using a straight lumber piece constructed in accordance with the present invention. All the pieces are pre-machined to constitute a prefabricated kit which is easily assembled by unskilled labor. As shown in FIG. 11 the railed fence is constituted essentially by a horizontal top rail 70, a bottom attachment plate 71 and edge floor board 73 and a plurality of rail posts 74 all interconnected by fasteners 72.

Figure 12E:
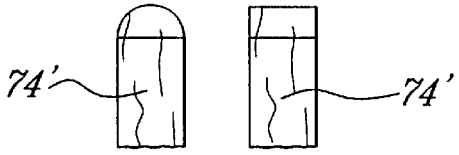
FIG. 12*e* is a fragmented top side view showing alternative constructions of end sections of the rail posts.

As can be seen more clearly from FIGS. 12*a* to 12*e* the straight lumber piece is herein constituted by the top rail 70 which is provided with a plurality of spacing grooves 75 formed in the side surface 76 of the top rail and extending to lower side edge 77 thereof. The spacing grooves terminate short of the top side edge 77' and are herein shown as having a rounded end 78 which is formed by a router bit head (not shown) which is used to rout these grooves. The ends 78 of the grooves could also be made square but this would be more costly to produce and these are adapted to receive in close fit therein the top end portions 74' of the rails 74. These top end portions may have the shapes as shown in FIG. 12*e* wherein one could be round or square to fit within these shape ends 78 of the grooves 75.

As shown in FIG. 12*b* the bottom attachment plate 73 is also provided with edge spacing grooves 79 which are spaced at intervals corresponding to the grooves 75 wherein a portion of the rails 74 will extend through these spacing grooves 79. The edge floorboard 73 is secured adjacent the top edge of the deck flooring 80, as shown in FIG. 12*a*.

With specific reference to FIG. 12*d* there is shown the construction of the bottom attachment plate 71. It also constitutes a straight board piece provided with spacing grooves 81 and wherein the ends 82 of the spacing grooves may have a rounded shape or a square shape such as shown at 82' to accommodate the shape of the rails 74. A saw blade slit 83 extends from the base 82 and 82' of the spacing grooves 81 and extend to the lower side edge 84 of the bottom attachment plate 71. The slits 83 are used to drain rain water that may have a tendency to accumulate in these channels. Accordingly, it can be seen that a railing constructed in accordance with the present invention provides perfectly aligned rail posts and a perfectly disposed horizontal top rail. The rail post 74 may be predrilled, such as shown at 85 to receive the fasteners 72 therein. The top rail 70 could also be predrilled, if desired.

Figure 13:
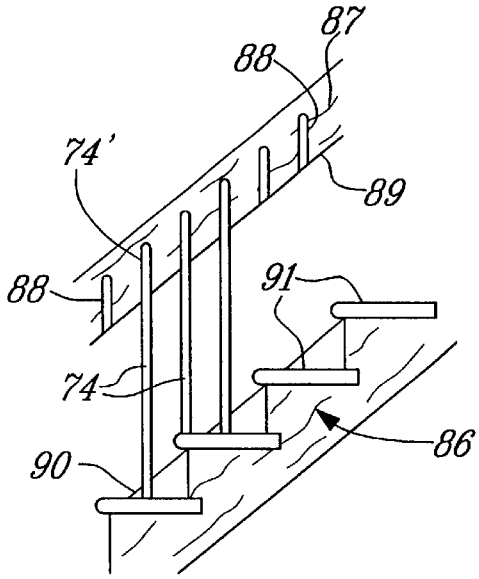
FIG. 13 is a simplified fragmented side view showing the construction of the stair rail using the grooved construction lumber element of the present invention.

With reference now to FIG. 13 there is shown a railing for a staircase 86 and constructed substantially in accordance with the present invention. As hereinshown, the top rail 87 is provided with spacing grooves 88 disposed parallel to one another and extending from a lower edge 89 of the rail 87 these are disposed at a transverse angle which has the same pitch as the pitch of the staircase 86. The grooves are constructed as with FIG. 12*c* to receive the top end portions 74' of the rail post 74 therein. The top portion of the rail posts may be secured in a bottom rail plank 90 also grooved similarly to that shown in FIG. 12*d* but disposed at an angle or else may be secured directly to the side edges of the stairs 91.

Figure 14:
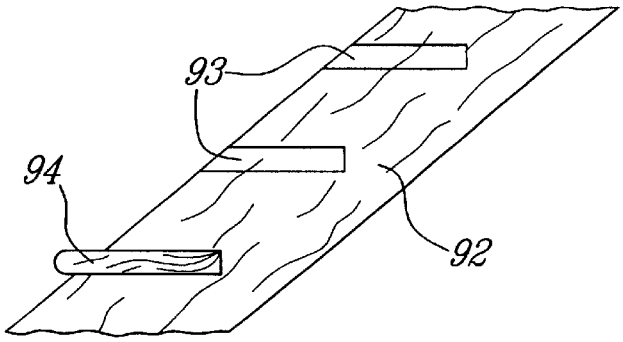
FIG. 14 is a simplified plan view showing the construction of a stair side support using a grooved construction lumber element of the present invention.

FIG. 14 illustrates a still further embodiment wherein the side support planks 92 are used to construct staircases and wherein the grooves 93 are also disposed at an angle therein to accommodate horizontal stair boards 94. These side supports 92 may be formed with the same stair rail 87 but used for a different purpose.

It is within the ambit of the present invention to cover any obvious modifications of the examples of the preferred embodiment described herein, provided such modifications fall within the scope of the appended claims.

What is claimed is:

1. A grooved construction lumber element for use in constructing of habitable lumber structures, said construction lumber element being comprised of an elongated straight lumber piece of rectangular cross-section and having a top and a bottom parallel side surface and narrow parallel side edge surfaces, a plurality of rectangular spacing grooves disposed in at least one of said top and bottom parallel side surfaces of said lumber piece and extending between said opposed parallel side edge surfaces, said spacing grooves having a predetermined depth and width and being configured to receive in tight fit a rectangular end portion of an associated further lumber element of like rectangular cross-section and extending transverse to said horizontal surface between said opposed vertical surfaces, said spacing grooves being connection grooves for connecting lumber elements to said straight lumber piece at specific locations to construct an habitable lumber structure, therebeing one or more groups of said spacing grooves on said elongated straight lumber piece, each group having a different interval spacing of said grooves throughout the length of said lumber piece, visual indication means affixed on said straight lumber piece adjacent each said spacing grooves whereby to identify each spacing groove associated with each said groups said spacing grooves having a common width, therebeing an end spacing groove at opposed ends of said straight lumber piece, said end spacing groove extending to opposed end edges of said straight lumber piece and having a common width which is half the width of said other spacing grooves.

2. A grooved construction lumber element as claimed in claim 1 wherein said lumber element is fabricated from a lumber material selected from wood, plastic, laminates, composites or any other such suitable material.

3. A grooved construction lumber element as claimed in claim 1 wherein said visual identification means is one of a shaped symbol, a color symbol or a number.

4. A grooved construction lumber element as claimed in claim 1 wherein, a transverse saw blade slit extends across said flat surface and spaced from each said opposed end edges a distance equal to the width of said other spacing grooves, said transverse saw blade slit having the same depth as said grooves and permitting extension of said end spacing groove by remove of an intermediate lumber piece between said end spacing grove and said slit whereby said end spacing groove may have the same width as said other spacing grooves.

5. A grooved construction lumber element as claimed in claim 4 wherein said straight lumber piece is a base or top runner utilized in the framing of walls, said spacing grooves accommodating a connecting end of a wall framing stud, said studs being located in spacing grooves associated with a selected one of said groups of spacing grooves.

6. A grooved construction lumber element as claimed in claim 1 wherein said straight lumber piece is a stud, said spacing grooves being formed in one of said side edge surfaces of said stud to accommodate a transverse furring strip to secure a wall covering material thereto.

7. A grooved construction lumber element as claimed in claim 1 wherein said straight lumber piece is a stud, said spacing grooves being formed in said opposed flat side surfaces, therebeing at least one groove in each of said opposed flat side surfaces and aligned with one another to receive an end portion of a transverse brace element.

8. A grooved construction lumber element as claimed in claim 7 wherein said brace element is a wood brace element having a rectangular cross-section, and a saw blade slit extending transversely a predetermined distance from an end of said brace element to allow the removal of an end portion of said wood brace element to brace and end stud to an adjacent stud.

9. A grooved construction lumber element for use in constructing lumber structures, said construction lumber element being comprised of an elongated straight lumber piece of rectangular cross-section and having a plurality of spacing grooves disposed in at least one of opposed flat parallel surfaces of said lumber piece between opposed parallel side edge surfaces, said spacing grooves having a predetermined depth and width and being configured to receive therein a rectangular end portion of an associated further lumber element of like rectangular cross-section and extending transverse to said horizontal surface between said opposed vertical surfaces, said spacing grooves being connection grooves for connecting lumber elements to said straight lumber piece at specific locations to construct a lumber structure, therebeing one or more groups of said spacing grooves, each group having a different interval spacing of said grooves throughout the length of said lumber piece; Spacing grooves have a common width, therebeing an end spacing groove at opposed ends of said straight lumber piece, said end spacing groove extending to opposed end edges of said straight lumber piece and having a width which is half the width of said other spacing grooves, and a transverse saw blade slit extending across said flat surface and spaced from each said opposed end edges a distance equal to the width of said other spacing grooves, said transverse saw blade slit having the same depth as said grooves and permitting extension of said end spacing groove by removal of an intermediate lumber piece between said end spacing groove and said slit whereby said end spacing groove may have the same width as said other spacing grooves.

* * * * *